United States Patent [19]

Atago et al.

[11] 4,411,232

[45] Oct. 25, 1983

[54] METHOD OF CONTROLLING AIR-FUEL RATIO IN INTERNAL COMBUSTION ENGINE

[75] Inventors: Takeshi Atago; Toshio Manaka, both of Katsuta, Japan

[73] Assignee: Hitachi, Ltd., Tokyo, Japan

[21] Appl. No.: 259,163

[22] Filed: Apr. 30, 1981

[30] Foreign Application Priority Data

May 6, 1980 [JP] Japan ..... 55-58682

[51] Int. Cl.[3] ..... F02D 33/00

[52] U.S. Cl. ..... 123/438; 123/440; 123/480; 123/492; 123/494

[58] Field of Search ..... 123/492, 440, 438, 489, 123/480, 494

[56] References Cited

U.S. PATENT DOCUMENTS 4,086,890 5/1978 Minami et al. ..... 123/440
4,212,065 7/1980 Marchak et al. ..... 123/480
4,245,605 1/1981 Rice et al. ..... 123/492
4,285,319 8/1981 Hattori et al. ..... 123/489
4,349,877 9/1982 Oyama et al. ..... 123/438

*Primary Examiner*—Charles J. Myhre
*Assistant Examiner*—Andrew M. Dolinar
*Attorney, Agent, or Firm*—Antonelli, Terry & Wands

[57] ABSTRACT

Method of controlling a control system for an air-fuel ratio of air-fuel mixture supplied to an internal combustion engine so that the proper air-fuel ratio is obtained over the whole operation range including a normal operation region and an accelerating operation mode independently of a decrease in oxygen contents at places of high altitudes. When the accelerating operation region is sensed, a proper power duty, corresponding to a negative pressure at that time, is read out from a data table stored in a read-only memory and added to a duty pulse signal which is then utilized for controlling a fuel supply actuator.

3 Claims, 15 Drawing Figures

METHOD OF CONTROLLING AIR-FUEL RATIO IN INTERNAL COMBUSTION ENGINE

BACKGROUND OF THE INVENTION

The present invention relates to a method of controlling an air-fuel ratio for a gaseous fuel mixture supply device such as a carburetor, a fuel injector or the like of an electronically controlled type suited for use in an internal combustion engine of a motor vehicle adapted to be driven on high altitude roads.

As the environmental pollution becomes of more important concern, the statutory regulation for the exhaust gas emanated from internal combustion engine becomes more and more strigent to such a level that the regulation can not be satisfied unless the air-fuel ratio is controlled with a high precision in dependence upon every operating condition of the engine.

In this conjunction, the known carburetor which is designed so as to control the air-fuel ratio in dependence on the engine operating conditions primarily with mechanical control members has encountered difficulty in obtaining numerous parameters representative of the engine operating conditions to be reflected in the engine control. In reality, it is practically impossible to control the air-fuel ratio with a high precision so that the statutory exhaust gas regulation can be fairly satisfied. Under the circumstances, there has been developed so-called electronic control type carburetors.

For controlling the air-fuel ratio in the carburetor, there is known in the prior art a bellows type absolute pressure sensor (U.S. Pat. No. 4,086,890). However, because the control of air-fuel ratio can not be effected taking into consideration the engine operation at the time the motor vehicle is maneuvered at places of high altitudes where oxygen content in air is low, the air-fuel ratio is decreased in the direction to enrich the fuel mixture at the place of high altitude to run against the exhaust gas regulation.

A typical example of the air-fuel ratio control apparatus of electronic type outlined above is illustrated in FIGS. 1 to 3 and FIG. 6 and will be described below in some detail to have a better understanding of the invention.

Referring to the FIGS. 1–3 and 6 an internal combustion engine 1 (hereinafter referred to simply as the engine) is provided with a carburetor 2, a slow solenoid 3, a main solenoid 4, a fuel solenoid 5, a limit switch 6, actuator 7 a throttle actuater, an intake negative pressure sensor 8, a cooling water temperature sensor 9, an engine revolution number sensor 10 of a pulse generator type, an $O_2$-sensor 11, a control unit 12, and a relative negative pressure detecting switch 13 of a conventional type for detecting a relative pressure or pressure difference between the atmospheric pressure and the negative pressure prevailing in the engine.

Referring to FIG. 2, the carburetor 2 has a primary intake passage 112 and a secondary intake passage 114. It is to be noted that the carburetor 2 is of the type which has no choke valve. A primary throttle valve 116 and a secondary throttle valve 118 are disposed in the primary and secondary passages 112, 114, respectively. At the same time, a primary venturi 20 and a secondary venturi 22 are formed at the upstream sides of respective throttle valves 116, 118. A primary nozzle 124 opens into the primary venturi 120. The nozzle 124 is communicated with a float chamber 128 through a main fuel passage 126 of primary side. The primary main fuel passage 126 incorporates a primary main air bleed 130, an emulsion tube 132 and a primary main jet 134 which are known per se. An auxiliary main jet 136 extends in parallel with the primary main jet 134 so as to communicate the float chamber 128 with the primary main fuel passage 126. This auxiliary main jet 136 is adapted to be opened and closed by means of the main solenoid 4 driven by a pulse signal of a predetermined duty ratio.

A primary slow fuel passage 140 shunting from the primary main fuel passage 126 at an intermediate portion of the latter is in communication with a bypass hole 142 opening near the primary throttle valve 116 and also with an idle hole 144. The primary slow fuel passage 140 is provided with a primary slow fuel jet 146 and a primary slow air bleed 148. An auxiliary slow air bleed 150, extending in parallel with the primary slow air bleed 148, provides a communication between the atmosphere and the primary slow fuel passage 140. The auxiliary slow air bleed 150 is adapted to be opened and closed by means of the slow solenoid 3. On the other hand, a secondary venturi 122 formed in the secondary intake passage 114 adjacent to the primary intake passage 112 has a secondary nozzle 154 opened therein. The nozzle 154 communicates with the float chamber 128 through a secondary main fuel passage (not shown). Needless to say, the secondary intake passage 114 is provided with a known secondary slow fuel passage. The secondary intake passage 114 is provided with an initiation passage 160 as well as an air passage 162 and a fuel passage 164 which are supplied with air and fuel, respectively. The air-fuel mixture, supplied to the initiation passages 160, is controlled by a valve element 166 actuated by the fuel solenoid 5 which is also electrically driven by the pulse signal of a predetermined duty ratio.

With the arrangement described above, the fuel-air ratio in the slow and main solenoid system of the carburetor 2 is controlled by controlling the slow solenoid 3 and the main solenoid 4, while the air-fuel ratio in the enriching system of the carburetor 2 can be controlled through the control of the fuel solenoid 5.

Referring to FIG. 3 which illustrates an example of the control unit 12, the latter is composed of a data processing unit 22, a central processing unit 23, a read-only memory (ROM) 24, a multiplexer 25, an analog-to-digital or A/D converter 26 and the like. Analog data signals such as the output signal $T_w$ from the cooling water temperature sensor 9 representing the temperature of the engine cooling water, the output signal $V_c$ from the negative pressure sensor 8 representing the suction or intake negative pressure and the output signal $O_2$ from the $O_2$-sensor 11 are supplied to the data processing unit 22 by way of the multiplexer 25 and the A/D converter 26, while the digital data signals such as the output signal $L_iSW$ from the limit switch 6, the output signal $V_cSW$ derived from the negative pressure switch 13 and the engine revolution signal N derived from the revolution number sensor 10 are directly transmitted to the data processing unit 22, whereby all the input data signals are processed by means of the central processing unit 23 in cooperation with the ROM 24 for controlling the various actuators such as the slow solenoid 3, the main solenoid 4, the fuel solenoid 5, the throttle actuator 7 and so forth so as to attain an optimal air-fuel ratio in dependence on the operating conditions of the engine.

With the arrangement of the air-fuel ratio control unit described above, the control is performed for attaining the optimal air-fuel ratio through the control of the slow solenoid 3 and the main solenoid 4 in the normal operation mode in dependence on data representative of the respective engine operating conditions. On the other hand, in the warming operation mode, the air-fuel ratio is controlled to an optimum value through the corresponding control of the fuel solenoid 5. Moreover, the engine revolution number in the idling and the continuous warming modes can be controlled to optimum by correspondingly controlling the throttle actuator 7.

In this connection, the control of the opening degree of the solenoid valves 3, 4 and 5 is performed on the basis of the so-called ON/OFF duty control. Basically, these solenoid valves are actuated with a predetermined period T so as to be turned on or opened for a predetermined time t for every period T, thereby the opening degree of these solenoid valves is controlled by varying the ratio of the time t to the period T, i.e. the ratio t/T. This ratio t/T multiplied by 100 is herein referred to as "ON-duty". Thus, it will be appreciated that the air-fuel ratio in the slow and main solenoid system can be controlled in a manner graphically illustrated in FIG. 4 with the aid of the control unit 12 which is capable of controlling the ON-duty of the slow solenoid 3 and the main solenoid 4. As can be seen from FIGS. 1 and 3, the signal for controlling the main solenoid 4 corresponds to the one which is obtained by inverting the signal for controlling the solenoid 3 by an inverter The electronic control described above is performed as based on a numerical data map which is stored in the ROM 24 and prepared in such a manner that the ON-duty data D required for controlling the slow and the main solenoids so as to maintain the air-fuel ratio constant for a given engine revolution number N and a given intake negative pressure $V_c$, as is illustrated in FIG. 5 by way of example. With such map control, the air-fuel ratio can be controlled with a high accuracy in a much facilitated manner.

Additionally, a so-called $O_2$-feedback control system is provided which is adapted to control the air-fuel ratio after the data derived from the map data has been corrected in consideration of the actual air-fuel ratio which is determined by detecting the content of $O_2$ contained in the exhaust gas by means of the $O_2$-sensor 11. The $O_2$-feedback control system is made effective, when the control of the air-fuel ratio based on the stored data map tends to be deviated from the correct values for some reason.

By the way, in the case of the internal combustion engine, it is required to supply an air-fuel mixture which is considerably enriched as compared with the ideal air-fuel ratio of 14.7 in the normal operation region, when an increased engine power is to be produced by increasing correspondingly the aperture of the throttle valve 116. To this end, the negative pressure switch 13 is provided which is closed when the intake negative pressure $V_c$ is shifted into a region defined between the atmospheric pressure and a predetermined negative pressure a close to the atmospheric pressure in response to a large aperture provided by the throttle valve 116. As a result, the data $V_cSW$ is supplied to the control unit 12. In this connection, it may be conceived that the ON-duty of the slow and the main solenoid valves 3, 4, as determined on the basis of the stored data map is additively increased by a predetermined value, when the negative pressure signal $V_cSW$ is supplied.

In more detail, reference is to be made to FIG. 6 which graphically illustrates a characteristic relationship between the ON-duty data D and the intake negative pressure $V_c$ in the engine operation of a motor vehicle, for example, running on a road of a low altitude corresponding to the sea level. More particularly, the ON-duty data D is given by a characteristic value MAP determined by the intake negative pressure $V_c$ read from the stored map data at the engine revolution number N of a given value. For the convenience of description, the characteristic quantity MAP is represented by a straight line.

When the suction or intake negative pressure is in a region B, defined between a given value a and the atmospheric pressure, the $O_2$-feedback control is stopped and the negative pressure switch 13 is closed to supply the data $V_cSW$, as the result of which the ON-duty data D1 determined on the basis of the characteristic value MAP of the stored map data is added with a predetermined value C. Thus, the solenoids 3 and 4 (refer to FIG. 2) are supplied with the signal representative of the ON-duty data D2 represented by a characteristic curve A, whereby the air-fuel mixture gas is enriched in the powered or accelerating operation region B, enabling an adequate power to be produced by the engine. At that time, although the exhaust gas is deteriorated as compared with that of the normal operation, the requirement imposed by the statutory exhaust gas regulation is still satisfied.

By the way, the range in which motor vehicles are driven is extended as the road condition is improved, thereby resulting in the motor vehicles being more frequently operated at places of higher altitudes. Of course, the exhaust gas regulations are statutorily established and applied to the driving of the motor vehicle at the places or locations of such high altitudes. Thus, an air-fuel ratio controlling system to meet such regulations has been more in demand.

It is however noted that with the known air-fuel control system described above, the air-fuel ratio is undesirably changed to a remarkably degree in the direction to enrich the mixture upon entrance into the accelerating operation mode at the place of high altitude, whereby the engine operation may run against the exhaust gas regulation.

More specifically, when the atmospheric pressure becomes lower as the altitude becomes higher, the contents of oxygen ($O_2$) contained in air of a given volume is correspondingly decreased. Consequently, for a same volume of the air-fuel mixture gas, the requirements imposed by the exhaust gas regulation will not be met unless the part of fuel is correspondingly reduced when the atmospheric pressure becomes lower, since the content of $O_2$ is then decreased. In the case of the normal driving state of the known control system described above, by virtue of the $O_2$-feedback control which is operative in response to the output signal from the $O_2$-sensor 11 and effective to correct the ON-duty of the slow and the main solenoids 3, 4 on the basis of the stored map data, the air-fuel ratio can be maintained at a proper value notwithstanding the changes in altitude, giving rise to no problems. However, upon entrance into the powered or accelerating operation mode, the air-fuel ratio will considerably be deviated to the enriching sense, because a predetermined fuel quantity C is constantly added to the value obtained from the stored map in the state of stopping the $O_2$-feedback control.

For particulars, reference is to be made to FIGS. 7 and 8. Referring to FIG. 7 in which the intake negative pressure $V_c$ is taken along the abscissa in terms of the absolute pressure as labelled with $V_{ca}$, it will be seen that even though the characteristic MAP correction data D1 is given from CPU 23 on the basis of the data map as in the case described hereinbefore in conjunction with FIG. 6, the fuel quantity decreases as indicated by a characteristic curve P, since the ON-duty data D1 is modified under the control of the $O_2$-feedback control loop, as the absolute negative pressure $V_{ca}$ output from the absolute negative pressure sensor 8 is lowered. As a result, the air-fuel ratio is no longer maintained at the optimal value, say, of 14.7 in the region outside the powered (or accelerating) operation region, as indicated by a characteristic curve J in FIG. 8.

By the way, the characteristic curve A in the powered or accelerating operation region B is obtained simply by adding the predetermined constant value C to the characteristic value P depending to the map data upon stopping of the $O_2$-feedback control, with the quantity C remaining invariable even when the altitude and hence the atmospheric pressure undergoes variations, as is shown in FIG. 7. Consequently, the gaseous fuel mixture will be enriched as the content of $O_2$ in a given volume of air is decreased due to the lowered atmospheric pressure, as can be seen from a characteristic curve E shown in FIG. 8. In the powered operation region B, i.e. in the operation mode in which the acceleration pedal is depressed to a large degree, the statutory exhaust gas regulation can still be met when the control is performed in a manner represented by a characteristic curve I shown in FIG. 8 which corresponds to a characteristic curve H shown in FIG. 7. In actuality, however, the fuel mixture will be disadvantageously enriched by an increment G at the absolute negative pressure a, as indicated by a characteristic curve E (which corresponds to the characteristic curve A shown in FIG. 7).

Thus, the known air-fuel ratio control system has encountered difficulty in that the requirement imposed by the exhaust gas regulation can not be satisfied at places of high altitudes.

SUMMARY OF THE INVENTION

Accordingly, an object of the invention is to provide an air-fuel ratio control method for internal combustion engines which method is immune to the shortcomings of the known control methods such as described above and which is capable of controlling the air-fuel ratio with a reasonably high accuracy over a whole operation range inclusive of the normal operation region as well as the powered or accelerating operation region even when the content of oxygen in the atmosphere is significantly decreased for some reasons such as attributable to the engine operation at a place of a high altitude.

In view of the above and other objects which will become apparent as description proceeds, it is proposed according to a general aspect of the invention that a negative pressure switch for detecting a relative pressure difference (referred to also as the relative negative pressure) between the atmospheric pressure and the intake negative pressure is provided and that the atmospheric pressure at which the negative pressure switch is turned on is discriminatively detected for effecting required corrections or compensations in the accelerating operation region or mode.

DESCRIPTION OF THE PREFERRED EMBODIMENTS

Figure 1:
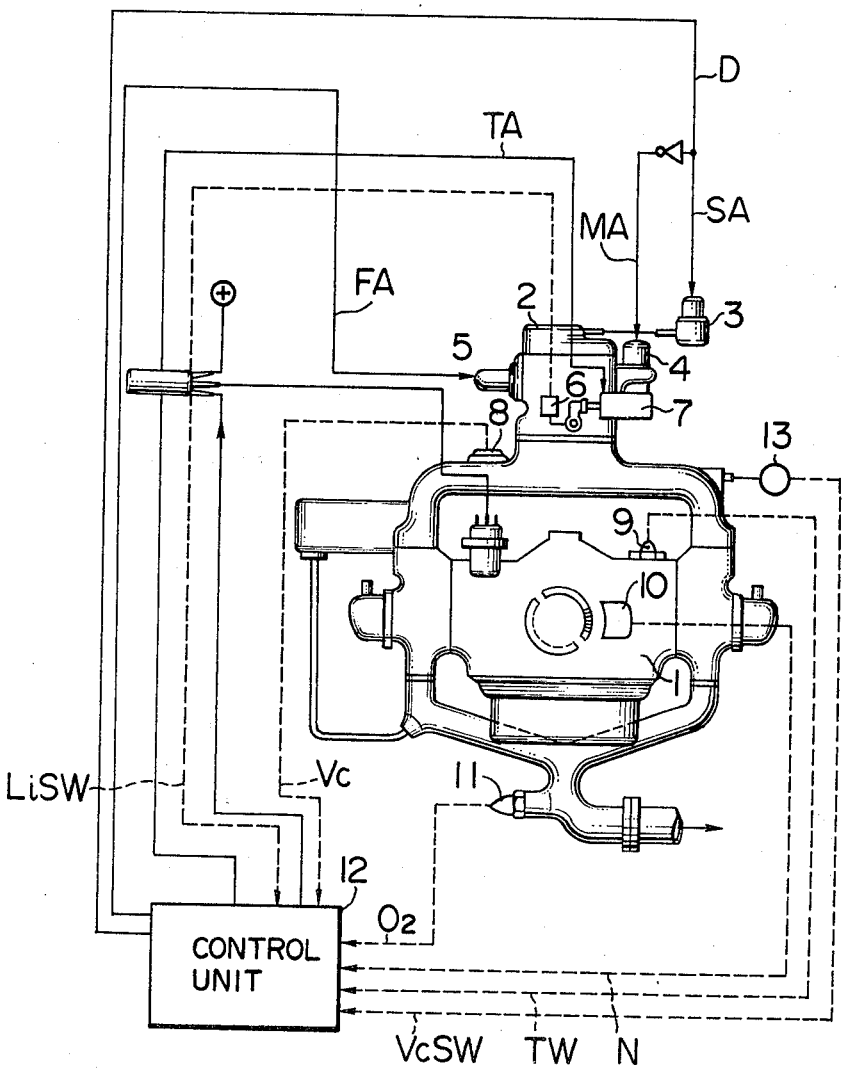
FIG. 1 PRIOR ART
FIG. 1 shows a general arrangement of a known system of an electronic type for controlling the air-fuel ratio of a gaseous mixture produced by a carburetor.

Now, the exemplary embodiments of the air-fuel ratio controlling system according to the invention will be described in detail by referring to the drawings.

Figure 2:
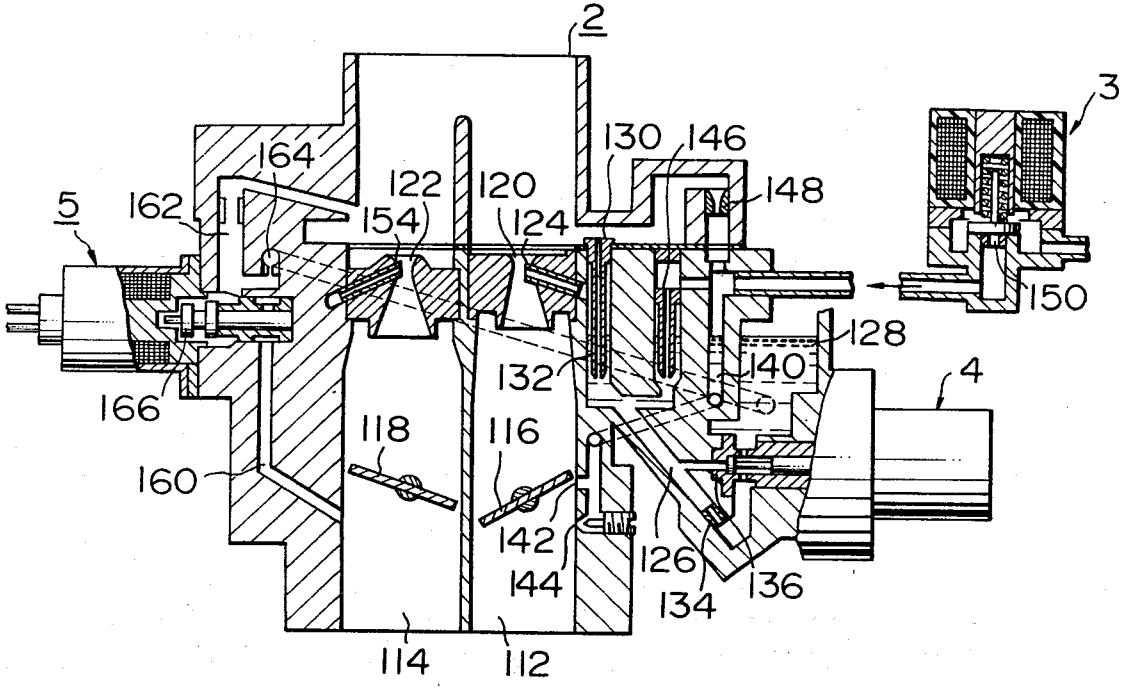
FIG. 2 PRIOR ART
FIG. 2 is an enlarged sectional view showing the carburetor used in the system shown in FIG. 1.
Figure 3:
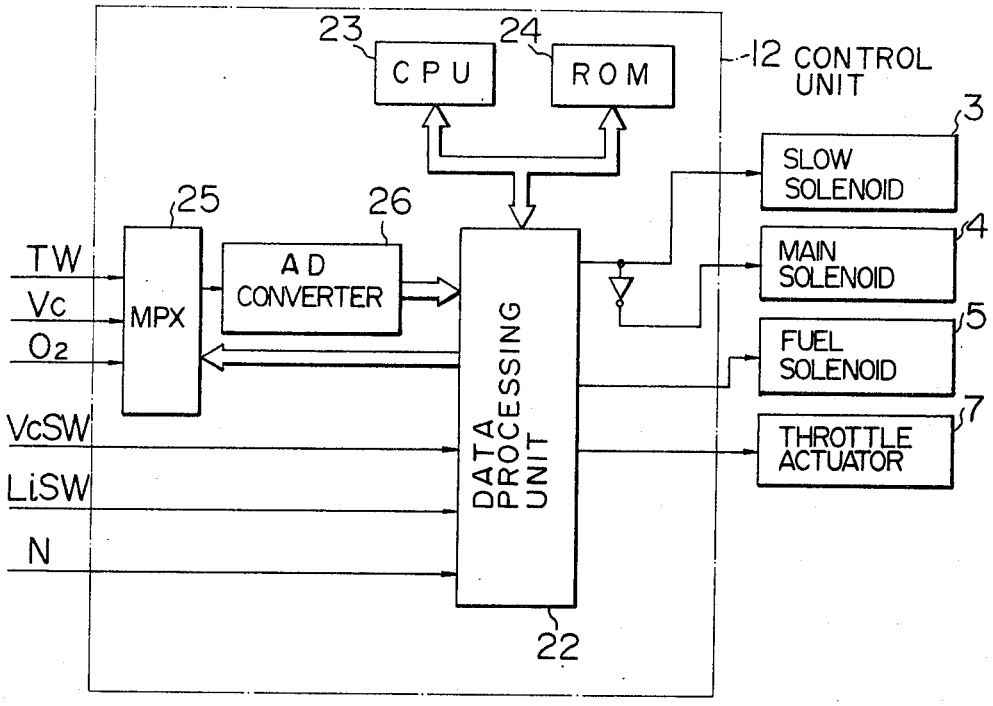
FIG. 3 PRIOR ART
FIG. 3 is a block diagram showing a general arrangement of a control unit employed in the system shown in FIG. 1.
Figure 4:
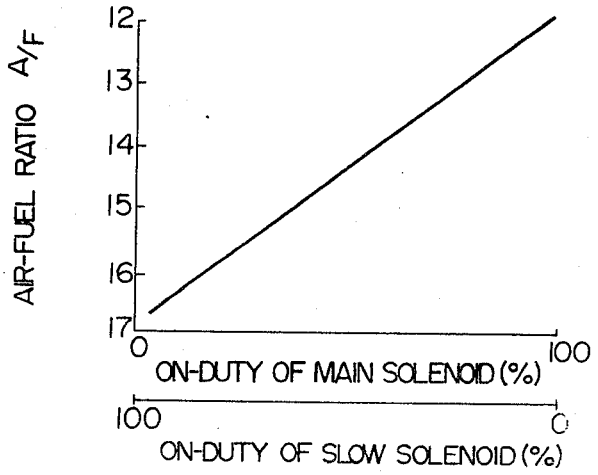
FIG. 4 graphically illustrates characteristics of the air-fuel ratio control effected by slow and main solenoids employed in the system shown in FIG. 1.
Figure 5:
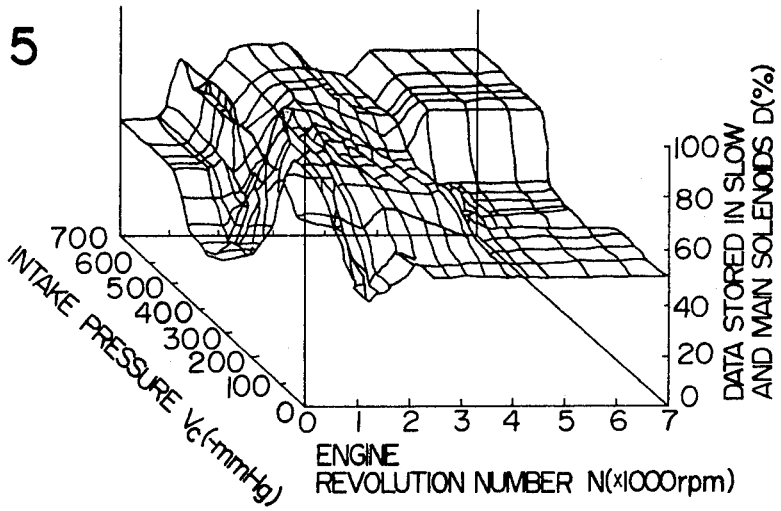
FIG. 5 is a graph to illustrate pictorially a data map stored in a ROM used in the control unit shown in FIG. 3.

The air-fuel ratio control system for carrying out the method according to the invention may be implemented in a substantially same manner as the known system illustrated with FIGS. 1 to 3 in respect to hardwares and structural arrangement except that the intake negative pressure sensor 8 is constituted by an intake negative pressure sensor of an absolute pressure detection type which per se has been known and that the output data of the sensor is available in terms of the absolute negative pressure $V_{ca}$.

Further, the control operation of the air-fuel ratio control system of an electronic controller type is executed by means of the control unit 12 in accordance with a program contained in the central processing unit or CPU 23 constituting a part of the control unit 12.

The air-fuel ratio controlling method according to the invention is carried out as one of the control operations effected by the control unit 12. An exemplary manner in which the control method according to the invention is carried out will be described below by referring first to a flow chart shown in FIG. 9.

Figure 6:
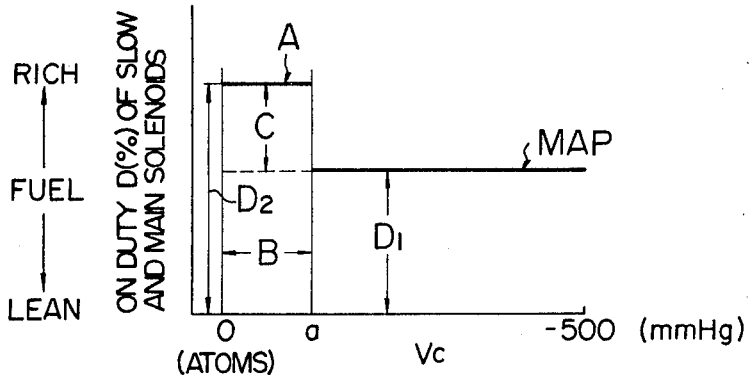
FIG. 6 PRIOR ART
FIG. 6 illustrates characteristically a relation between ON-duty of the slow and main solenoids and the intake negative pressure in a powered (or accelerating) operation region as adopted in the hitherto known control system.

The control program as illustrated is, for example, executed every 40 ms. Upon entry of the execution, at the step 202, it is detected whether the relative negative pressure switch 13 is on or off. When the negative pressure switch 13, which serves for detection of the relative negative pressure (or pressure difference) between the atmospheric pressure and the absolute intake negative pressure, is in the OFF-state, this means that the absolute negative pressure $V_{ca}$ prevailing in the intake manifold of the engine is significantly lower than the atmospheric pressure, that is closer to vacuum than the negative pressure a shown in FIG. 6, which in turn means that the engine is operated in the normal operation region outside the powered (or accelerating) operation region B. At the next step 204, data of the revolution number N and data of the absolute negative pressure $V_{ca}$ are obtained from the revolution number sensor 10 and the absolute negative pressure sensor 8, respectively. At a succeeding step 206, ON-duty data $D_{SM}$ for the slow and the main solenoids are read out from the data map stored in the ROM 24. The data map is so prepared as to be made use of for controlling the air-fuel ratio at a predetermined value when the engine is in the state of e.g. 20° C. and 760 mmHg.

At the next step 208, ON-duty data $D'_{SM}$ for the slow and the main solenoids 3,4 required to attain a predetermined air-fuel ratio on the basis of data available from the $O_2$-sensor 11 through the $O_2$-feedback loop is arithmetically determined. The predetermined air-fuel ratio mentioned above is also referred to as $\lambda(=1)$. On the basis of the decision result obtained at the step 208, data $D_{SM}$ read out from the data map is corrected to the data $D'_{SM}$ arithmetically determined for the $O_2$-feedback control at a succeeding step 210. The $O_2$-feedback control is described in detail in commonly assigned U.S. patent application No. 161153, now U.S. Pat. No. 4,363,209.

Steps 204 to 210 constitutes the so-called $O_2$-feedback control.

Figure 9:
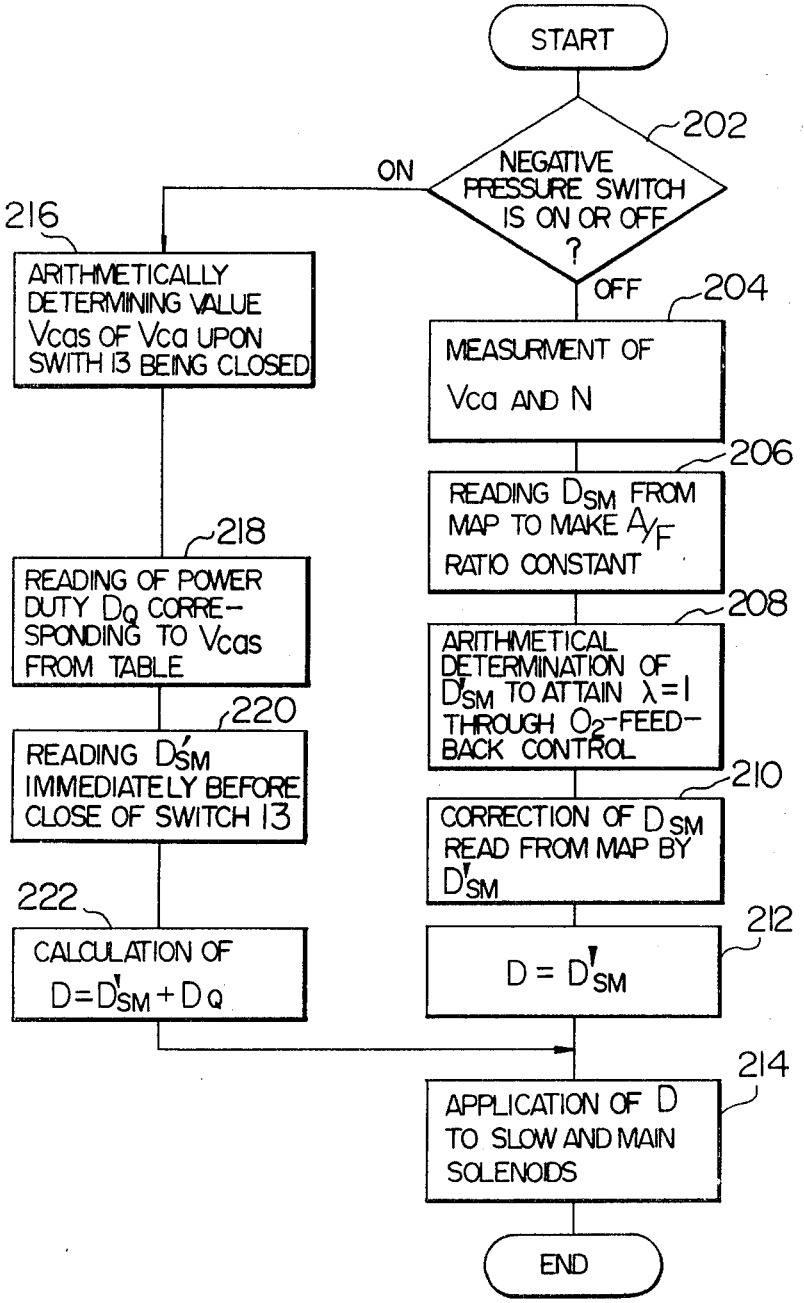
FIG. 9 is a flow chart showing an example of the air-fuel ratio controlling method according to the invention.

At the steps 212, 214 the data $D'_{SM}$ is supplied to the slow and the main solenoids 3 and 4 (FIGS. 1 and 2) as the ON-duty data D. At a step 212, ON-duty data D is altered to data $D'_{SM}$ and stored in a RAM incorporated in CPU at a previously designated address. Data $D'_{SM}$ thus stored in the RAM is updated every time the routine shown at the righthand side in the flow chart of FIG. 9 is executed. Data thus updated is utilized later on. The execution of program comes to an end when duty-data D is applied to the slow and the main solenoids 3,4.

In this way, the ON-duty data available from the stored map as the data D1 is correctly modified to the characteristic quantity P described hereinabove in conjunction with FIG. 7, whereby the air-fuel ratio is maintained at $\lambda=1$ in the normal operation region independently from variations in the atmospheric pressure due to difference in altitude.

Figure 10:
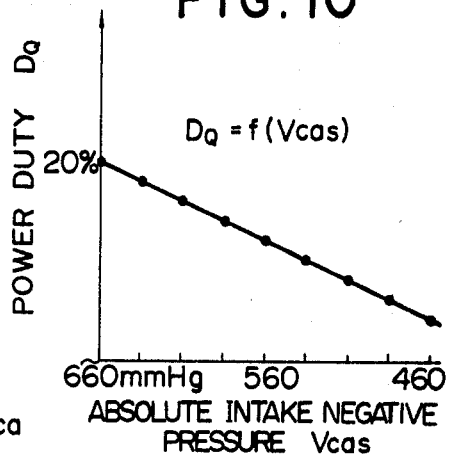
FIG. 10 graphically illustrates a data table stored in a ROM.

On the other hand, when the negative pressure switch 13 is detected to be in the ON-state at the step 202, this means that the absolute intake negative pressure $V_{ca}$ is closer to the atmospheric pressure than to the negative pressure a, indicating that the engine is operated in the powered (or acceleration) region B. Then, the value $V_{cas}$ of the absolute negative pressure $V_{ca}$ at the instant when the switch 13 is turned on is sampled at a step 216 shown in FIG. 9. At a succeeding step 218, ON-duty data $D_Q$ which corresponds to the data $V_{cas}$ and may be referred to as the power duty data, is read out from a data table such as shown in FIG. 10 and stored in the ROM 24. At the step 220, data $D'_{SM}$ correctly modified through the $O_2$-feedback control immediately before the negative pressure switch 13 is turned on is read out from the RAM. Subsequently, at the next step 222, the power duty data $D_Q$ is added to the data $D'_{SM}$ to obtain data D which is utilized for driving the slow and the main solenoids 3 and 4 at a step 214. Then, the execution of the instant program comes to an end. It is to be noted that the duty data $D_Q$ is never of a constant value or magnitude, as will be described hereinafter.

Figure 8:
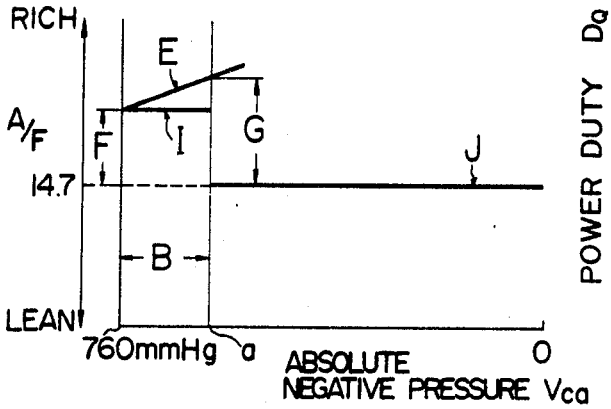
FIG. 8 illustrates a characteristic relationship between the absolute negative pressure and the air-fuel ratio.
Figure 11:
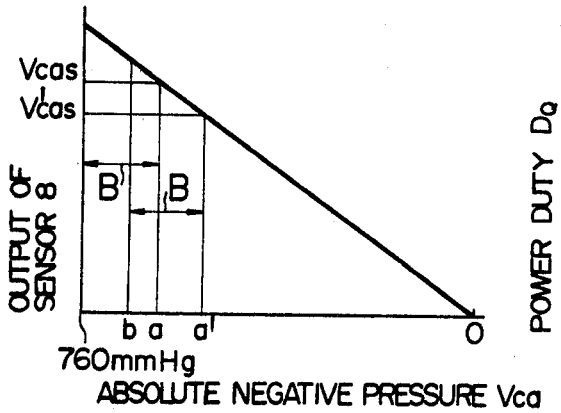
FIG. 11 graphically illustrates the characteristic relationships between the absolute negative pressure and the outputs of an intake negative pressure sensor and a negative pressure switch.

The data $V_{cas}$ obtained after execution of the program represents the atmospheric pressure at that time. More specifically, referring to FIG. 11, the negative pressure switch 13 is actuated in response to the difference between the absolute negative pressure $V_{ca}$ and the atmospheric pressure, i.e. the relative negative pressure defined hereinbefore. The negative pressure which causes the switch 13 to be turned ON from the OFF-state corresponds to a pressure level a' which is deviated from the point a shown in FIG. 6 (or FIG. 8).

More particularly, when the atmospheric pressure is 760 mmHg, the switch 13 is actuated at the negative pressure a. However, when the atmospheric pressure is lowered to the level or point b at, for example, a higher altitude, the switch 13 is caused to operate at the pressure level a'. Consequently, the data $V_{cas}$ available at the atmospheric pressure of 760 mmHg naturally differs from the data $V'_{cas}$ available at the atmospheric pressure of the level b. These data $V_{cas}$ and $V'_{cas}$ respectively represent the atmospheric pressures at which the switch 13 are actuated.

Figure 12:
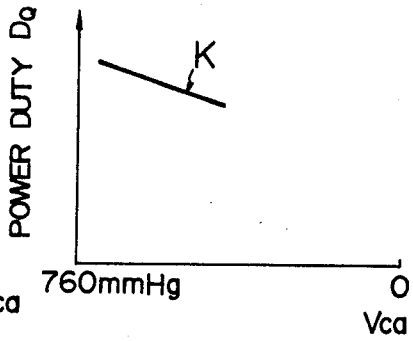
FIG. 12 illustrates the characteristic variation in ON-duty as a function of the absolute negative pressure.

The power duty data $D_Q$ read out from the stored data table on the basis of the data $V_{cas}$ takes a value variable in dependence on the atmospheric pressure at which the negative pressure switch 13 is actuated, as indicated by a characteristic curve K shown in FIG. 12.

Figure 7:
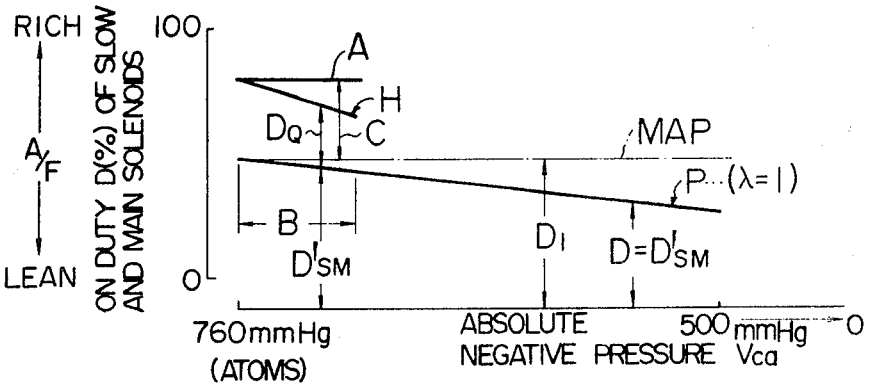
FIG. 7 illustrates characteristic relationships between an absolute intake negative pressure and the ON-duty of the slow and main solenoids.

Thus, when the powered (or acceleration) operation region B has been attained during the execution of the program described above, then the ON-duty of the slow and the main solenoids 3,4 are controlled in accordance with the characteristic curve H which is obtained by adding to the characteristic quantity P the power duty data $D_Q$ in which variations in the atmospheric pressure is considered, in place of the predetermined constant value C (refer to FIG. 7). As the consequence, the air-fuel ratio is maintained at a predetermined constant value independently of variations in the atmospheric pressure as indicated by the characteristic curve I in FIG. 8, whereby the drawbacks of the known system described hereinbefore can successfully be eliminated.

Figure 15:
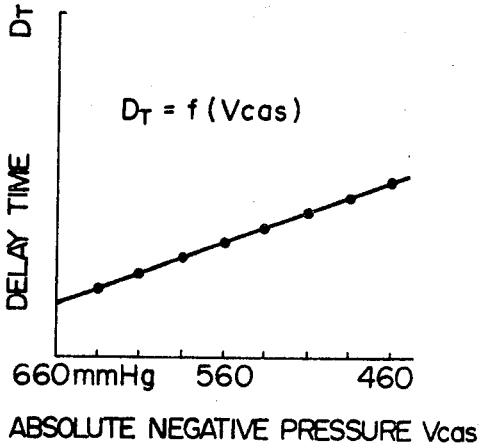
FIG. 15 graphically illustrates a data table stored in a ROM.
Figure 13:
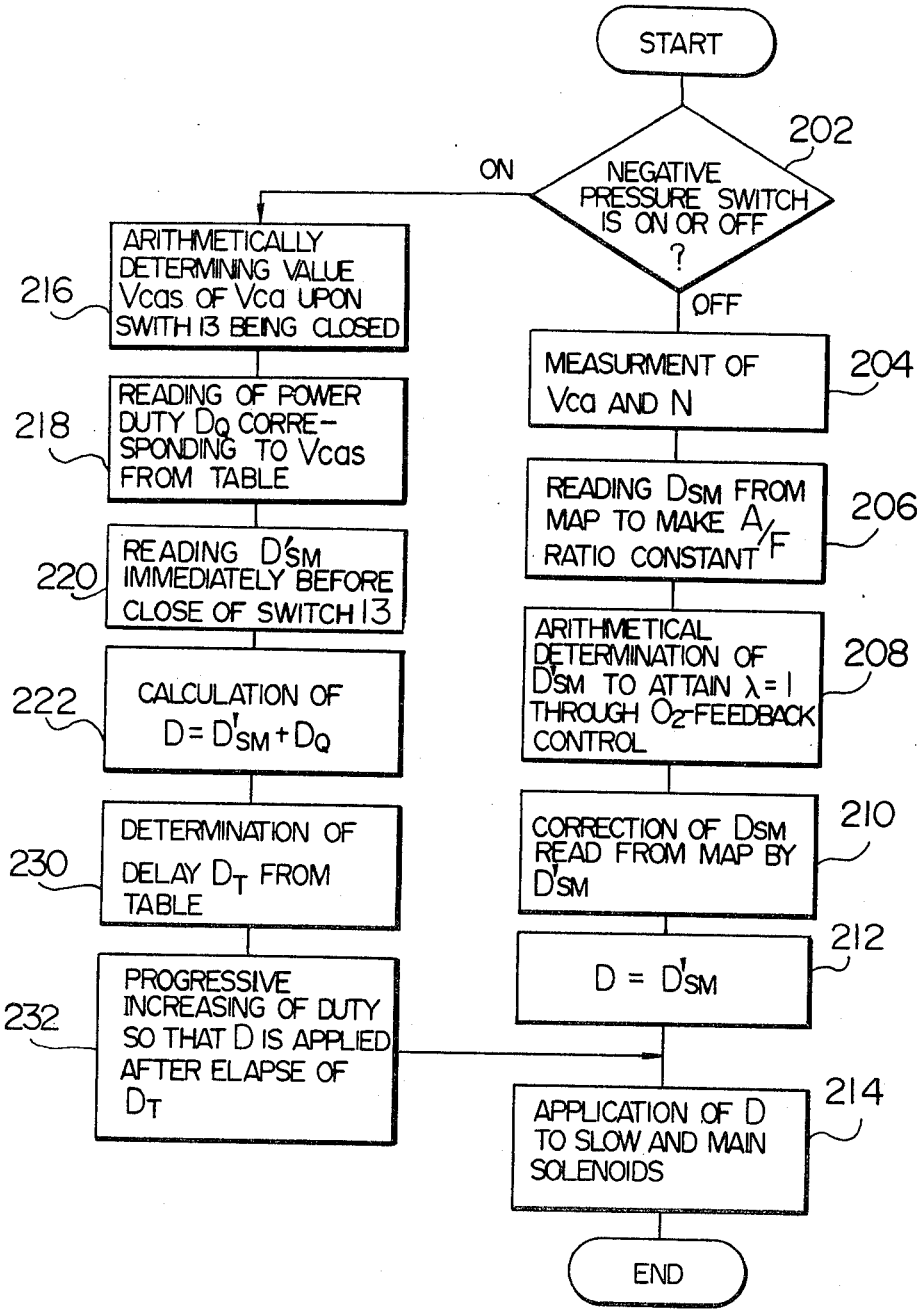
FIG. 13 is a flow chart to illustrate another exemplary manner in which the control method according to the invention may be carried out.

FIG. 13 illustrates in a flow chart those control operations which are performed in another example of the present invention, which differs from the flow chart shown in FIG. 9 only in the steps 230 and 232. When the ON-duty data D for driving the slow and the main solenoids 3,4 is obtained as the result of addition of the power ON-duty $D_Q$ to the data $D'_{SM}$ obtained through the $O_2$-feedback control at a step 222, then a time delay $D_T$ is determined as a function of the data $V_{cas}$ from the data table such as shown in FIG. 15 and stored in the ROM 24 at a succeeding step 230. At the next step 232, the power ON-duty D for the solenoids 3 and 4 is increased not instantaneously but progressively (i.e. on the increment-by-increment base) so that the duty D becomes fully effective only after the delay time $D_T$. The delay and the increment can be implemented by making use of a soft timer function of the data processing unit 22.

Finally, the data D is set for the slow and the main solenoids 3 and 4 at a step 214, whereby the execution of program has come to an end.

It will be seen that the time delay $D_T$ is increased as altitude becomes higher. By increasing progressively the ON-duty data D to be supplied to the solenoids 3 and 4 during the time delay $D_T$, the ON-duty data undergoes a gentle variation, assuring a more comfortable ride in the motor vehicle. Moreover, drift or chattering which may occur upon variation in the duty data can be positively suppressed by making use of the time delay $D_T$ in the manner described above.

Figure 14:
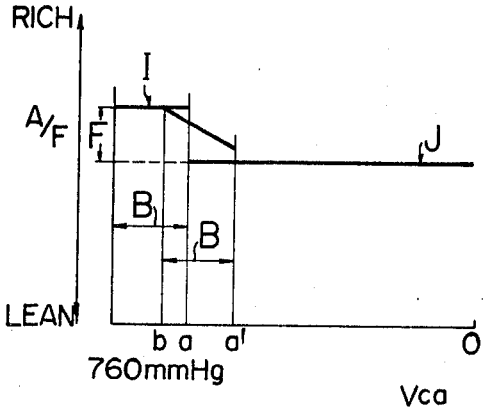
FIG. 14 illustrates a characteristic relationship between the absolute negative pressure and the air-fuel ratio.

In this way, the operation characteristic represented by the curve I according to which the air-fuel ratio is varied in accordance with the prevailing atmospheric pressure can be obtained even in the powered operation region B by making use of the power ON-duty data $D_Q$, as illustrated in FIG. 14. Thus, even when the engine operation frequently takes place in the powered or acceleration region B during maneuvering at high altitudes, a degradation in a comfort of the ride as well as the maneuverability can be prevented.

In a similar manner, by virtue of the time delay $D_T$ intervening in control, possible deterioration of the air-fuel ratio and the maneuverability attributable to the increased frequency at which the engine operation takes place in the powered operation region can be fairly excluded.

In the foregoing description, it has been assumed that the intake negative pressure sensor 8 is constituted by a sensor which is adapted to detect the absolute negative pressure, while the negative pressure sensor 13 is constituted by a switch actuated in response to the relative pressure (or pressure difference). However, it is possible to employ the intake negative pressure sensor which is adapted to detect the relative pressure while using the negative pressure switch 13 operable in response to the absolute pressure for measuring the atmospheric pressure of interest. Accordingly, the exemplary embodiments disclosed herein are only to serve for illustrative purpose.

It will now be appreciated that the invention has proposed an air-fuel ratio controlling system of the electronic controller type which can is capable of controlling the air-fuel ratio so as to satisfy the statutory exhaust gas regulations without involving degradation of the exhaust gas with an improved accuracy over the whole operation range of the engine inclusive of the powered operation range as well as the normal operation range even at low atmospheric pressures and thus assures an excellent maneuverability of the motor vehicle.

Although the invention has been described as being applied to the internal combustion engines of carburetor type, it will be appreciated that the invention can be equally applied to internal combustion engines of fuel injection type.

We claim:

1. In a control system for controlling an air-fuel ratio of an air-fuel mixture supplied to an internal combustion engine, the system comprising a sensor for sensing an absolute intake negative pressure of said internal combustion engine, negative pressure switch means for detecting that a difference between the atmospheric pressure and said absolute intake negative pressure has attained a predetermined value, means for detecting a revolution number of said engine, a sensor for sensing a quantity of oxygen in the exhaust gas of said engine, means for controlling a fuel supply to said engine, and a data processing unit including a central processing unit and a read-only memory for executing arithmetic operation in order to control the air-fuel ratio in dependence upon output data derived from said sensors and detecting means, a method of controlling said control system in such a manner that the exhaust gas components are kept within a permissible range even in an accelerating operation at places of high altitude where an oxygen content in air is decreased, the method comprising the steps of:

(a) detecting the atmospheric pressure and the corresponding altitude by said absolute intake negative pressure sensor in dependence upon said negative pressure switch means detecting, that a difference between the atmospheric pressure and said absolute intake negative pressure has attained a predetermined value;

(b) arithmetically determining a fuel supply quantity which maintaines the exhaust gas components within the permissible range at the accelerating operation at the altitude detected in the detecting step; and (c) applying said arithmetically determined fuel supply quantity to said fuel supply control means.

2. A control method according to claim 1, wherein the step of arithmetically determining the fuel supply quantity comprises:

(a) arithmetically determining a fuel supply duty quantity in an $O_2$-feedback control by utilizing the output signals derived from said absolute intake negative pressure sensor, said revolution number detecting means, said oxygen quatity detecting sensor, and a data map for controlling the air-fuel ratio as stored in said read-only memory;

(b) arithmetically determining the output signal from said absolute intake negative pressure sensor at a point in time at which said negative pressure switch means is actuated;

(c) reading out an increment duty signal from a data table stored in the read-only memory for accelerating operation corresponding to the output signal obtained as a result of the arithmetic determination of the fuel supply duty quantity; and (d) obtaining an acceleration duty signal by adding said increment duty signal to the arithmetically determined fuel supply duty quantity.

3. A control method according to claim 2, wherein said step of arithmetically determining said fuel supply quantity further comprises:

reading a time delay corresponding to said acceleration duty signal from a data table stored in said read-only memory, and progressively increasing a duty ratio so that said acceleration duty signal is produced after a lapse of said time delay.

* * * * *